US007954555B2

(12) United States Patent
Ashy et al.

(10) Patent No.: US 7,954,555 B2
(45) Date of Patent: Jun. 7, 2011

(54) FULL FUNCTION DOWNHOLE VALVE AND METHOD OF OPERATING THE VALVE

(75) Inventors: Thomas M. Ashy, Lafatette, LA (US); Jace E. Melder, Erath, LA (US); Paul L. Connell, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 233 days.

(21) Appl. No.: 12/386,780

(22) Filed: Apr. 23, 2009

(65) Prior Publication Data

US 2010/0270030 A1 Oct. 28, 2010

(51) Int. Cl.
*E21B 34/06* (2006.01)

(52) U.S. Cl. ..... 166/386; 166/318; 166/374

(58) Field of Classification Search ..... 166/386, 166/374, 318, 329
See application file for complete search history.

(56) References Cited

U.S. PATENT DOCUMENTS

| | | | | |
|---|---|---|---|---|
| 3,527,297 | A * | 9/1970 | Todd | 166/154 |
| 3,633,671 | A * | 1/1972 | Nelson | 166/318 |
| 4,260,017 | A * | 4/1981 | Nelson et al. | 166/154 |
| 5,020,600 | A * | 6/1991 | Coronado | 166/387 |
| 5,024,273 | A * | 6/1991 | Coone et al. | 166/289 |
| 5,048,611 | A * | 9/1991 | Cochran | 166/374 |
| 5,174,379 | A * | 12/1992 | Whiteley et al. | 166/278 |
| 6,253,861 | B1 * | 7/2001 | Carmichael et al. | 175/237 |
| 6,571,875 | B2 * | 6/2003 | Bissonnette et al. | 166/278 |
| 7,011,153 | B2 * | 3/2006 | Erkol | 166/181 |
| 7,147,052 | B2 * | 12/2006 | Erkol | 166/181 |
| 7,500,526 | B2 * | 3/2009 | Telfer | 166/387 |
| 7,628,213 | B2 * | 12/2009 | Telfer | 166/381 |
| 7,661,478 | B2 * | 2/2010 | Palmer et al. | 166/318 |
| 7,665,545 | B2 * | 2/2010 | Telfer | 175/57 |
| 2003/0141059 | A1 * | 7/2003 | Mauldin et al. | 166/277 |
| 2004/0094304 | A1 * | 5/2004 | Turner et al. | 166/313 |
| 2007/0240883 | A1 * | 10/2007 | Telfer | 166/375 |
| 2008/0093080 | A1 * | 4/2008 | Palmer et al. | 166/318 |
| 2009/0056952 | A1 * | 3/2009 | Churchill | 166/373 |
| 2010/0270030 | A1 * | 10/2010 | Ashy et al. | 166/373 |
| 2010/0319927 | A1 * | 12/2010 | Yokley et al. | 166/373 |

OTHER PUBLICATIONS

Single-Action Bypass Sub brochure, 2007, p. 1, Mi Swaco, US.A.
Single-Action Bypass Sub Jetting Tool brochure, 2007, p. 1, Mi Swaco, U.S.A.
Dennis Denney, Pipe-Rotation Effect on Hole Cleaning for Water-Based Drilling Fluids in Horizontal and Deviated Wells, Journal of Petroleum Technology, Nov. 2008, pp. 65-66, 68; Society of Petroleum Engineers; USA.

* cited by examiner

*Primary Examiner* — Jennifer H Gay
(74) *Attorney, Agent, or Firm* — Greenberg Traurig LLP; Anthony F. Matheny

(57) ABSTRACT

Downhole valves comprise a housing having a bore, a port, upper and lower recesses disposed in an inner wall surface of the bore, the upper recess disposed above the port and the lower recess disposed below the port, and upper and lower pistons disposed in the bore. The upper and lower pistons each comprise a bore with a port in communication with housing bore. During run-in, the housing port is blocked by the lower piston. Actuation of the lower piston unblocks the housing port and aligns the lower piston port with the lower recess. Actuation of the upper piston closes the housing port and aligns the upper piston port with the upper recess. Alignment of the ports of the pistons with their respective recesses permits fluid flow through the tool both when the valve is opened by the lower piston and closed by the upper piston.

22 Claims, 6 Drawing Sheets

FULL FUNCTION DOWNHOLE VALVE AND METHOD OF OPERATING THE VALVE

BACKGROUND

1. Field of Invention

The inventions are directed to downhole valves for use in tool strings run into oil or gas wellbores and, in particular, to downhole valves that are capable of being opened and closed, while still permitting fluid flow through the downhole valve and, thus, through the tool string so that other downhole operations can be performed by devices located below the downhole valves.

2. Description of Art

Valves for use in downhole tools or to actuate downhole tools are generally known in the art. For example, valves are used to open and/or close passageways within downhole tools to direct fluid flow through the tool. Valves are also used in downhole tools, to open or close passageways from interior passageways within the downhole tool to the wellbore environment. In general, operation of these valves result in the closure of one passageway in favor of another passageway. As a result, fluid flowing through an original flow path is blocked while the fluid is flowing through the now opened secondary fluid flow path. One example of such a valve is a ball seat disposed in the bore of a downhole tool. Originally, fluid flow is permitted through the downhole tool by passing through the seat. A plug member, e.g., a ball, is then landed on the seat, thereby blocking the flow through the seat. The resultant build-up of pressure can actuate a downhole tool such as by causing shear screws to break, or, possibly, cause a rupture disk to break allowing the fluid to flow in one or more different directions, referred to herein as "secondary flow directions." Flow through the seat, however, remains blocked so that no fluid flow is permitted to pass below the seat. In other words, any fluid actuated operations below the seat are "on hold" until the ball can be removed from the seat. In addition, simple removal of the ball to allow the flow to be re-established through the downhole tool does not close the now opened secondary flow directions, so that the valve is not a "full function valve" permitting opening and closing of the secondary flow directions.

In another example of a previous valve, the valve is run into the wellbore in the "opened" position, i.e., fluid is permitted to flow from the annulus of the wellbore, through the ports in the housing of the valve and up the bore of the tool string. After locating the tool string and, thus, the valve, in the wellbore, the valve is actuated to close the valve to the annulus so that flow is only permitted to pass out the bottom of the valve. The valve can be actuated a second time to re-open the housing ports to re-establish flow to the annulus. These types of valves are referred to as "dual action" valves and, although they permit fluid to flow through the valve and out the bottom of the valve when the valve is in both its opened and closed position, they are not capable of being run into the wellbore in the closed position, fully actuated, and retrieved out of the wellbore in the closed position.

To the inventors' knowledge, current operations of downhole valves are incapable of being run into the wellbore in a closed position, actuated to redirect flow above the seat while still allowing flow through the downhole tool to allow tools and devices located below the seat so that additional operations can be simultaneously performed below the seat, and subsequently be actuated to close the redirected flow path above the seat while still allow flow through the downhole tool to allow operations to be performed by tools and devices located below the seat.

SUMMARY OF INVENTION

Broadly, the inventions disclosed herein comprise downhole valves having two valve actuating members such as pistons in sliding engagement with an inner wall surface of a tubular or housing. The housing includes a port for flow of fluid from the housing bore into the wellbore environment. The inner wall surface of the housing comprises an upper recess and a lower recess. Each of the upper and lower pistons comprise ports in fluid communication with each piston's bore and the outer wall surfaces of each of the pistons. The upper piston also includes an extension member so that when upper piston is moved downward to contact the lower piston, fluid flow from the upper piston's bore can flow into the housing bore and ultimately into the lower piston's bore.

In operation, the lower piston is initially disposed such that the lower piston's ports are above the lower recess and so that the piston blocks the housing ports so that the valve is in its closed position. The upper piston is initially disposed above the lower piston such that the ports of the upper piston are above the upper recess. The downhole valve is then run into the wellbore as part of a downhole tool string to the desired location or depth at which time a plug member, e.g., a ball, is landed on the upper end of the lower piston. Fluid pressure builds up above the lower piston forcing the lower piston downward until the housing ports are no longer blocked so that the downhole valve is in its "opened position," and the lower piston ports are at least partially aligned with the lower recess. In this arrangement, fluid is permitted to flow down the housing bore, through the upper piston bore, through the housing ports, and around the outer wall surface of the lower piston, into the lower recess, through the lower piston ports into the lower piston bore, and into the housing bore below the seat so that fluid flows outside the downhole valve through the housing ports, as well as down the tool string below the downhole valve.

A second plug member, e.g., ball can then be landed on the upper end of the upper piston, Fluid pressure builds up above the upper piston forcing the upper piston downward until the housing ports are blocked so that the downhole valve is in its "closed position," and the upper piston ports are at least partially aligned with the upper recess. The extension member(s) at the lower end of the upper piston can also be in contact with the upper end of the lower piston. In this arrangement, fluid is permitted to flow down the housing bore, around the outer wall surface of the upper piston, into the upper recess, through the upper piston ports into the upper piston bore, out of the upper piston bore below the upper piston, around the outer wall surface of the lower piston, into the lower recess, through the lower piston ports into the lower piston bore, and into the housing bore below the seat so that fluid flows down the tool string below the downhole valve. Thus, the downhole valve allows the valve to be opened and closed and still maintain fluid flow through the downhole valve.

BRIEF DESCRIPTION OF DRAWINGS

FIG. 1 is a perspective view of the downhole valve.

FIG. 2 is a cross-sectional view of the housing of the downhole valve.

FIG. 3 is a perspective view of an upper valve member of the downhole valve.

FIG. 4 is a cross-sectional view of the upper valve member of FIG. 3.

FIG. 5 is a cross-sectional view of the upper valve member of FIG. 4 taken along line 5 5.

FIG. 6 is a cross-sectional view of the upper valve member of FIG. 4 taken along line 6-6.

FIG. 7 is a perspective view of a lower valve member of the downhole valve.

FIG. 8 is a cross-sectional view of the lower valve member of FIG. 7.

FIG. 9 is a cross-sectional view of the lower valve member of FIG. 8 taken along line 9 9.

FIG. 10 is a cross-sectional view of downhole valve showing the lower valve member and the upper valve member in their respective run-in positions.

FIG. 11 is a cross-sectional view of downhole valve showing the lower valve member in the lower valve member set position and the upper valve member in the upper valve member run-in position.

FIG. 12 is a cross-sectional view of downhole valve showing the lower valve member and the upper valve member in their respective set positions.

FIG. 13 is a partial cross-sectional view of the downhole valve showing the upper and lower valve members in their respective set positions with the extension members of the upper piston in contact with the upper end of the lower piston.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
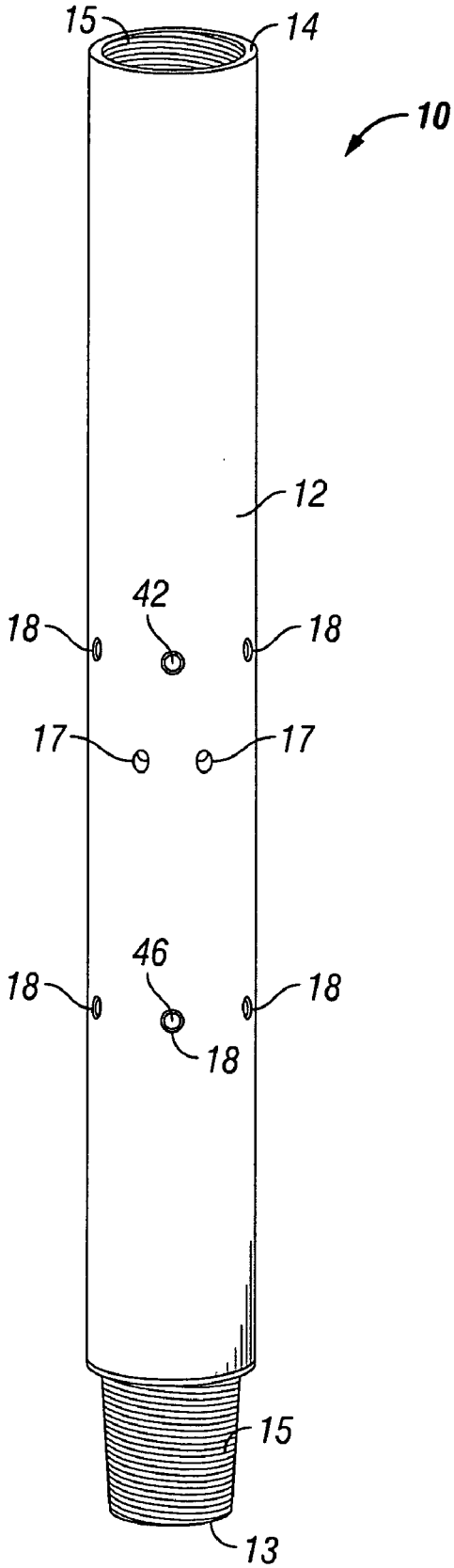
FIGS. 1-13 are various views of one specific embodiment of a downhole valve disclosed herein.

Referring now to the Figures, downhole valve 10 comprises housing 12 having lower end 13, upper end 14, and one or more ports 17. In certain specific embodiments, housing 12 also includes one or more shear screw ports 18 having shear screws 42, 46 (FIGS. 1 and 10-12) disposed therein. Although downhole valve 10 can be connected to a downhole string, e.g., a tool string, (not shown) using any method or device known in the art, as shown in FIG. 1, lower end 13 and upper end 14 include threads 15 for releasably connecting downhole valve 10 to other joints or components of the downhole string.

Figure 2:
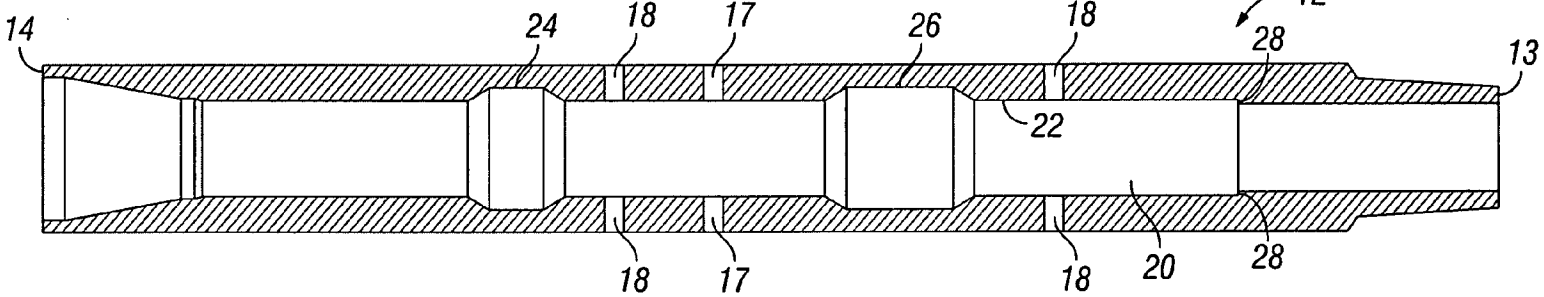

As illustrated in FIG. 2, housing 12 comprises bore 20 defined by inner wall surface 22. Inner wall surface 22 comprises upper recess 24 disposed above port 17, lower recess 26 disposed below port 17, and shoulder 28 disposed below lower recess 26. Although upper recess 24 and lower recess 26 may have any shape or depth, in one particular embodiment, lower recess 26 has a greater volume than upper recess 24. As will be recognized, housing bore 20 permits fluids to flow through downhole valve 10.

Figure 5:
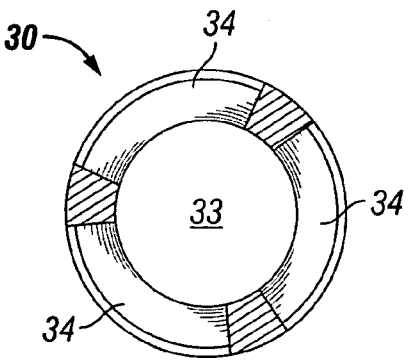

Referring now to FIGS. 3-6, upper valve member 30, which is shown as a piston in this embodiment, comprises upper end 31, lower end 32, upper valve member bore 33, and upper valve member ports 34. Upper valve member ports 34 are in fluid communication with upper valve member bore 33 and an outer wall surface of upper valve member 30. Although three upper valve member ports 34 are illustrated, it is to be understood that alternative embodiments can comprise only one upper valve member port 34. Further, it is to be understood that the number, size, and shape of each upper valve member ports 34 can be modified as desired or necessary to permit fluid flow from housing bore 20 through ports 34 and into upper valve member bore 33 as discussed in greater detail below. As shown in FIG. 5, upper valve member 30 has three upper valve member ports 34 disposed equidistant around the circumference of upper valve member 30 and, in particular, such that the center of each upper valve member port 34 is 120 degrees from the center of each adjacent upper valve member port 34.

Figure 3:
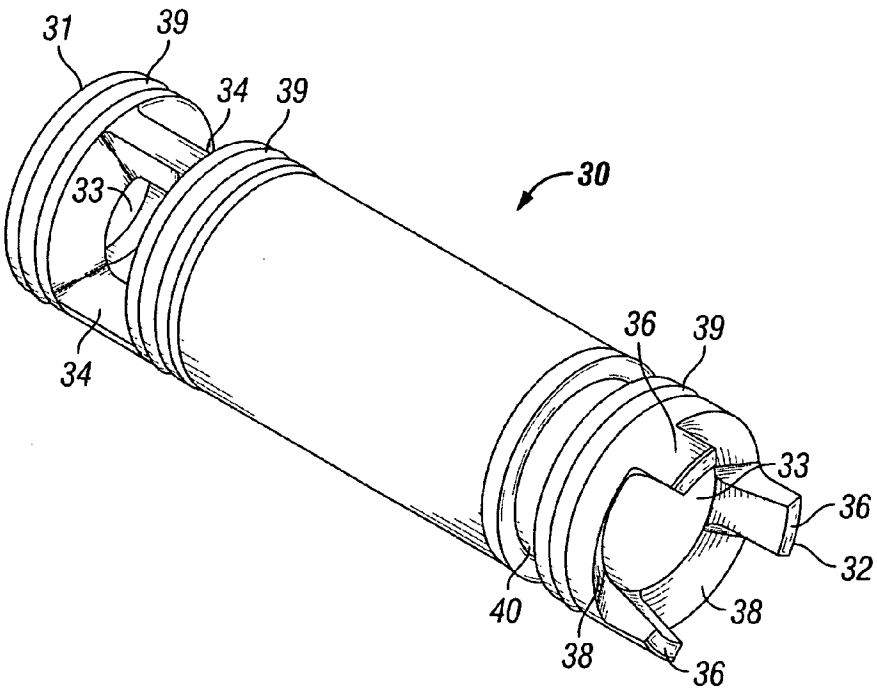
Figure 4:
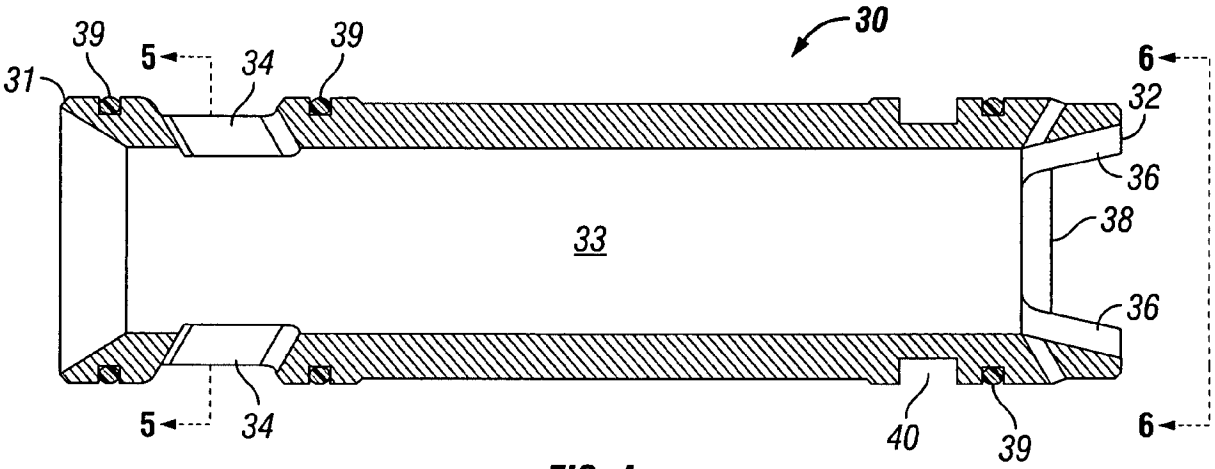
Figure 6:
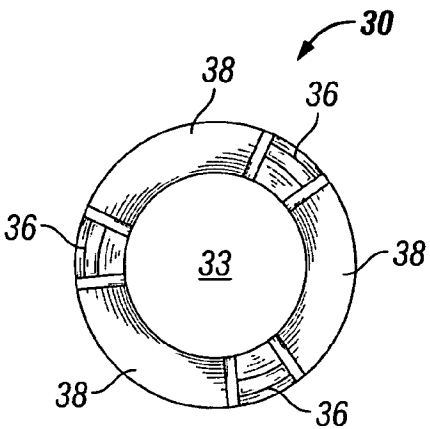

One or more (three are shown in FIGS. 3 and 6) extension members 36 at lower end 32 form windows 38 in upper valve member 30. In the embodiment shown in FIG. 6, the three extension members 36 are disposed equidistant from each other and, in particular, such that the center of each window 38 is 120 degrees from the center of each adjacent window 38. It is to be understood, however, that the location and disposition of each extension member 36 relative to the other extension member, and, thus, the size and shape of each resultant window 38 formed by extension member(s) 36 may be modified as desired or necessary to provide adequate support for upper valve member 30 on top of lower valve member 50 (see FIG. 13—not shown in FIG. 12 due to the orientation of upper valve member 30) and to facilitate adequate fluid flow through upper valve member bore 33 and into housing bore 20, when upper valve member 30 is in its set position as shown in FIG. 12 and discussed in greater detail below.

Figure 10:
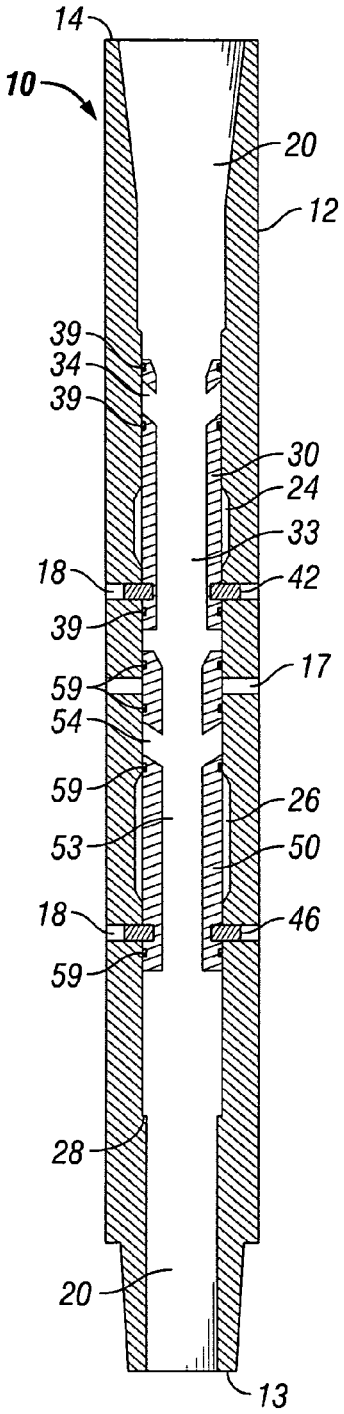
Figure 11:
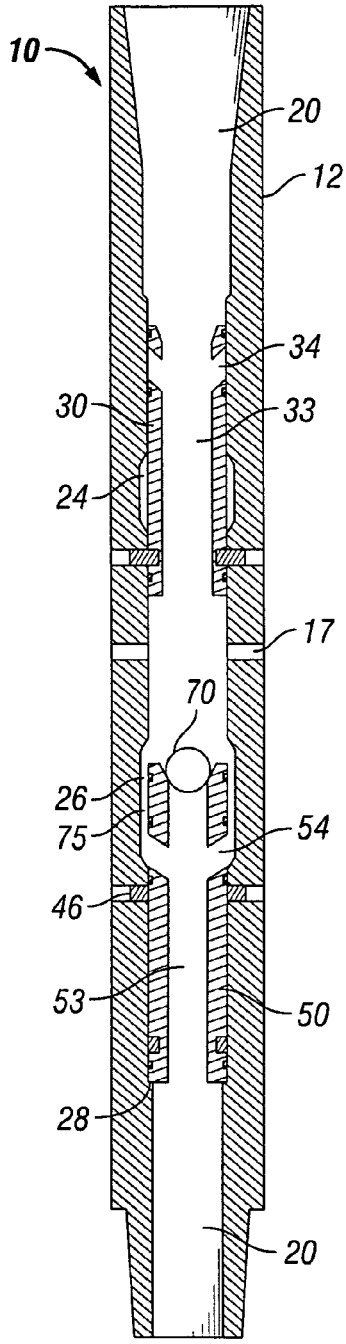
Figure 12:
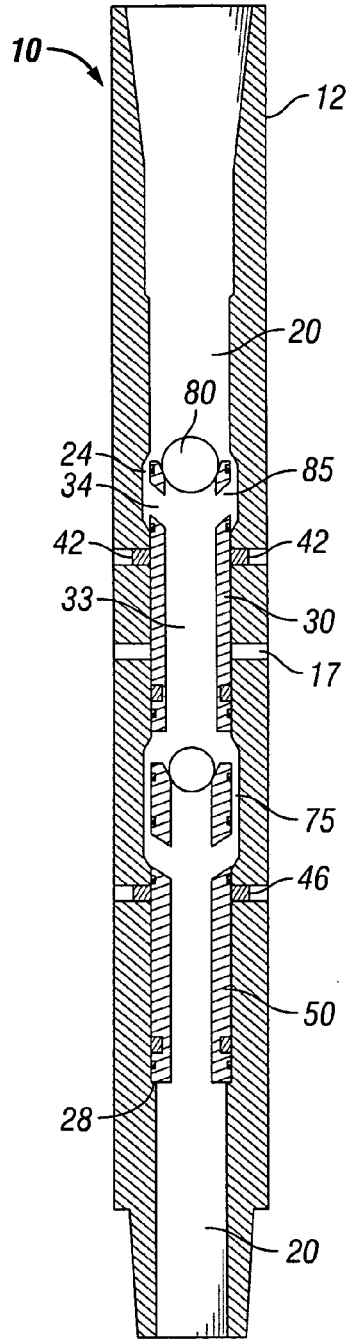

O-rings 39, or other suitable sealing devices, are disposed along the outer wall surface of upper valve member 30 to provide sealing engagement with inner wall surface 22 (shown best in FIGS. 10-12). In the embodiments shown, each o-ring 39 is disposed in a groove cut into the outer wall surface of upper valve member 30.

In the embodiment shown in FIGS. 3-6, upper valve member 30 also includes shear screw groove 40 for receiving a shear screw 42 (shown in FIGS. 10-12) disposed in shear screw ports 18 (shown in FIGS. 1, 2, and 10-12) for maintaining upper valve member 30 in its run-in position (FIGS. 10 and 11) until actuated. Shear screws and their functions are known in the art.

Figure 9:
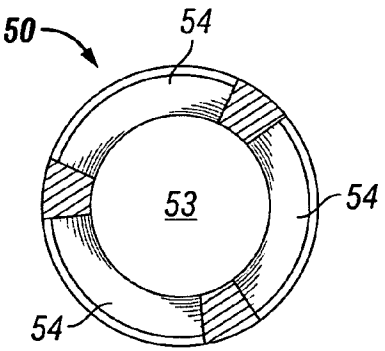
Figure 7:
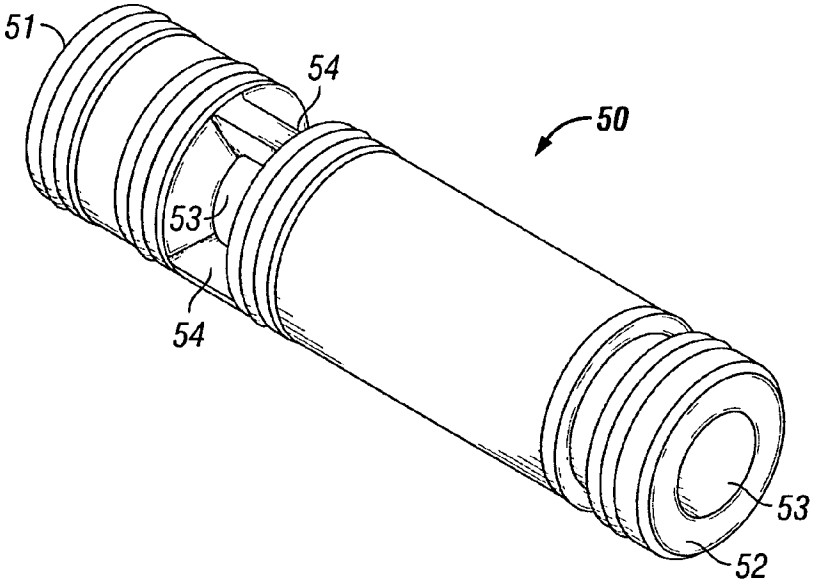
Figure 8:
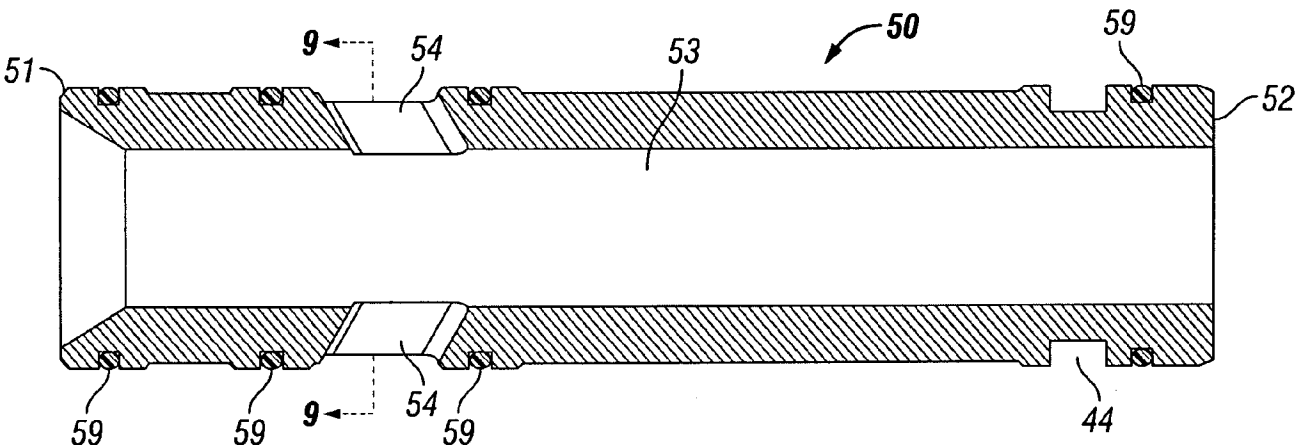

Referring now to FIGS. 7-9, lower valve member 50, which is shown as a piston in this embodiment, comprises upper end 51, lower end 52, lower valve member bore 53, and lower valve member ports 54. Lower valve member ports 54 are in fluid communication with lower valve member bore 53 and an outer wall surface of lower valve member 50. Although three lower valve member ports 54 are illustrated, it is to be understood that alternative embodiments can comprise only one lower valve member port 34. Further, it is to be understood that the number, size, and shape of each lower valve member ports 54 can be modified as desired or necessary to permit fluid flow from housing bore 20 through ports 54 and into lower valve member bore 53 as discussed in greater detail below. As shown in FIG. 9, lower valve member 50 has three lower valve member ports 54 disposed equidistant around the circumference of lower valve member 50 and, in particular, such that the center of each lower valve member port 54 is 120 degrees from the center of each adjacent lower valve member port 54.

O-rings 59, or other suitable sealing devices, are disposed along the outer wall surface of lower valve member 50 to provide sealing engagement with inner wall surface 22 (shown best in FIGS. 10-12). In the embodiments shown, each o-ring 59 is disposed in a groove cut into the outer wall surface of lower valve member 50.

In the embodiment shown in FIGS. 7-9, lower valve member 50 also includes shear screw groove 44 for receiving a shear screw 46 (shown in FIGS. 10-12) disposed in shear screw ports 18 (shown in FIGS. 1, 2, and 10-12) for maintaining lower valve member 50 in its run-in position (FIG. 10) until actuated.

Referring now to FIGS. 10-12, the assembly and operation of downhole valve 10 will be described in greater detail.

Downhole valve 10 is assembled by inserting upper valve member 30 and lower valve member 50 into bore 20 of housing 12 from upper end 13. In the shown embodiment, shear screws 42, 46 are inserted into shear screw ports 18 to maintain upper valve member 30 and lower valve member 50 in their respective run-in positions (FIG. 10 as to both upper valve member 30 and lower valve member 50, and FIG. 11 as to upper valve member 30). Although shear screws 42, 46 are used in the embodiment shown in the Figures, it is to be understood that any other mechanism or device, or no such mechanism or device other than friction, may be used to maintain upper valve member 30 and lower valve member 50 in their respective run-in positions.

As illustrated in FIG. 10, lower valve member 50 is initially blocking housing port 17 in its run-in position so that downhole valve 10 is in its closed position. O-rings 59 (or other seals or sealing devices known in the art, including metal-to-metal seals) initially isolate port 17 and shear screw ports 18. O-rings 59 also initially isolate lower recess 26.

As shown in FIGS. 10-11, upper valve member 30 is disposed above housing port 17 when in its run-in position. O-rings 39 (or other seals or sealing devices known in the art, including metal-to-metal seals) initially isolate shear screw ports 18 and upper recess 24.

After being assembled, downhole valve 10 is placed in a downhole string, or tool string, and run to depth in a wellbore (not shown). During run-in, downhole valve 10 can be in its run-in position shown in FIG. 10. After being disposed at the desired depth in the wellbore, a plug member such as ball 70 can then be dropped down the tool string and into bore 20 of downhole valve 10. The plug member is small enough to pass through upper valve member bore 33 but not small enough to pass through lower valve member bore 53. Therefore, the plug member lands on a seat disposed on upper end 51 of lower valve member 50 (FIGS. 10-11). Fluid pressure is then built up above lower valve member 50 until the fluid pressure exceeds the strength of shear screws 46 (or exceeds the resistance to movement of lower valve member 50). Thereafter, lower valve member 50 slides downward along inner wall surface 22 of housing 12 until lower end 52 contacts shoulder 28 as shown in FIG. 11. At this point, housing port 17 is opened, i.e., no longer blocked by lower valve member 50, so that fluid flow is established between housing bore 20 and the wellbore environment located outside downhole valve 10 and, thus, the tool string. Accordingly, downhole valve 10 is in its opened position. Thus, fluid is permitted to flow downward into housing bore 20, through upper valve member bore 33, back into housing bore 20, through housing port 17, and into the wellbore environment to perform any downhole operation in which fluid is required outside of the tool string.

Additionally, upon engaging lower end 52 with shoulder 28, lower valve member ports 54 are placed in fluid communication, either through partial or complete alignment, with lower recess 26 creating flow path 75 around the plug member, e.g., ball 70, along the outside of lower valve member 50 through lower valve member ports 54, into lower valve member bore 53, and into housing bore 20 below shoulder 28 so that the fluid flows through downhole valve 10 to be used as desired or necessary to perform additional downhole operations using tools or devices disposed below downhole valve 10.

Figure 13:
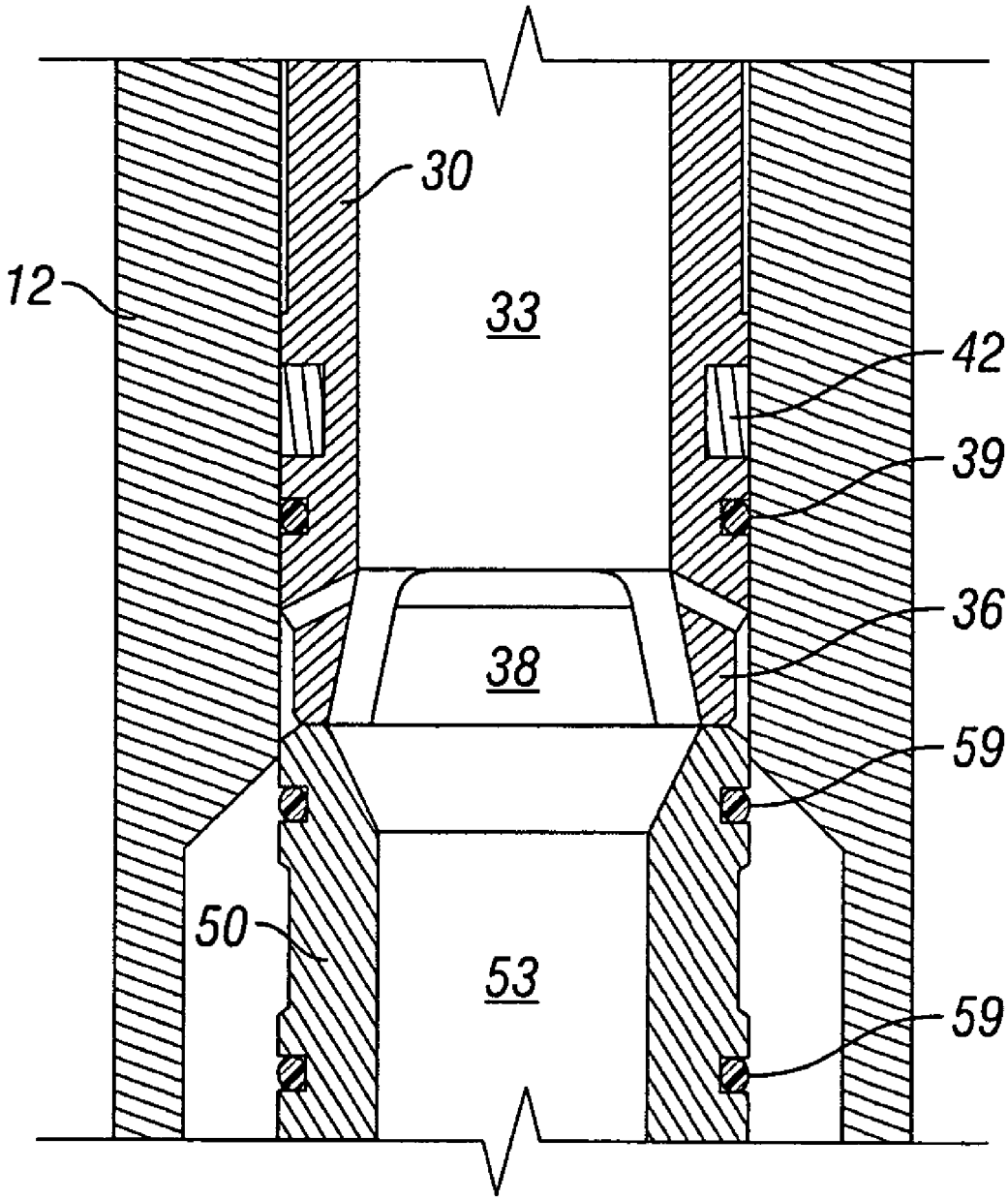

After fluid flow through housing port 17 is no longer needed or desired, a second plug member such as ball 80 is dropped down the tool string and into bore 20 of downhole valve 10. This plug member lands on a seat disposed on upper end 31 of upper valve member 30 (FIG. 12). Fluid pressure is then built up above upper valve member 30 until the fluid pressure exceeds the strength of shear screws 42 (or exceeds the resistance to movement of upper valve member 30). Thereafter, upper valve member 30 slides downward along inner wall surface 22 of housing 12 until extension members 36 at lower end 32 contact upper end 51 of lower valve member 50 (FIG. 13). At this point, housing port 17 is closed, i.e., blocked by upper valve member 30, so that fluid flow between housing bore 20 and the wellbore environment is blocked. Seals 39 facilitate closing housing ports 17 and, therefore, sizing of upper valve member 30 and lower valve member 50, and shoulder 29, is such to facilitate the timing of landing O-rings 39 across housing ports 17, i.e., locating O-rings 39 above and below housing ports 17. As shown in FIG. 12, downhole valve 10 is returned to its closed position.

Additionally, upon closing ports 17 and, in particular embodiments, engaging lower end 32 with upper end 51 of lower valve member 50, upper valve member ports 34 are placed in fluid communication, either through partial or complete alignment, with upper recess 24 creating flow path 85 around the plug member, e.g., ball 80, along the outside of upper valve member 30 through upper valve member ports 34, into upper valve member bore 33, and into housing bore 20 and/or lower recess 26, through lower valve member ports 54, into lower valve member bore 53, and into housing bore 20 below shoulder 28 so that the fluid flows through downhole valve 10 to be used as desired or necessary to perform additional downhole operations using tools or devices located below downhole valve 10.

It is to be understood that the invention is not limited to the exact details of construction, operation, exact materials, or embodiments shown and described, as modifications and equivalents will be apparent to one skilled in the art. For example, the inner wall surface of the housing may have one or more upper or lower recesses having and desired or necessary shape or size to permit sufficient fluid flow around the upper or lower valve members when in their respective set positions. Moreover, the inner wall surface of the housing may include a second shoulder located below the housing ports on to which the upper valve member sets when the upper valve member is in the set position. Further, the extension member(s) of the upper valve member may include a bottom ring connecting all of the extension member(s), thereby forming lower ports in the upper valve member as opposed to the windows shown in the Figures. In addition, in certain embodiments of the methods of use of the downhole valve, the downhole valve can be assembled such that the lower valve member is initially placed in its set position so that the housing ports are initially in the opened position. The downhole valve can then be run into the wellbore while in the opened position and, when desired, the upper valve member can be actuated to close the housing ports. These methods allow the downhole valve to be used in operations in which it is desired for fluid to fill up the bore of the tool string during run-in. Accordingly, the invention is therefore to be limited only by the scope of the appended claims.

What is claimed is:

1. A downhole valve comprising:

a housing comprising an upper end, a lower end, at least one port, and a bore disposed there-through, the bore comprising an inner wall surface having an upper recess and a lower recess, and the at least one port being in fluid communication with the housing bore and an outer wall surface of the housing;

a lower valve member, the lower valve member comprising a lower valve bore having at least one lower valve port in fluid communication with the lower valve bore and the bore of the housing;

an upper valve member disposed above the lower valve member, the upper valve member comprising an upper valve bore having at least one upper valve port in fluid communication with the upper valve bore and the bore of the housing, wherein the lower valve member comprises a run-in position in which the lower valve member blocks each of the at least one ports disposed in the housing and each of the at least one lower valve ports is disposed above the lower recess of the inner wall surface of the housing, and a set position in which each of the at least one ports disposed in the housing is not blocked by the lower valve member and each of the at least one lower valve ports is disposed in fluid communication with the lower recess of the inner wall surface of the housing, and wherein the upper valve member comprises a run-in position in which each of the at least one upper valve ports is disposed above the upper recess of the inner wall surface of the housing, and a set position in which each of the at least one ports disposed in the housing is blocked by the upper valve member, and each of the at least one upper valve ports is disposed in fluid communication with the upper recess of the inner wall surface of the housing, and wherein the lower recess comprises a larger volume than a volume of the upper recess.

2. The downhole valve of claim 1 wherein the lower valve member comprises a seat disposed at an upper end of the lower valve member for receiving a first plug member.

3. The downhole valve of claim 2 wherein the upper valve member comprises a seat disposed at an upper end of the upper valve member for receiving a second plug member, the second plug member being larger than the first plug member.

4. The downhole valve of claim 1, wherein the inner wall surface of the housing bore comprises a shoulder disposed below the lower valve member for engagement with a lower end of the lower valve member when the lower valve member is in the lower valve member set position.

5. The downhole valve of claim 1, wherein the lower valve member comprises three lower ports disposed equidistant around a circumference of the lower valve member.

6. The downhole valve of claim 5, wherein the upper valve member comprises three upper ports disposed equidistant around a circumference of the upper valve member.

7. A downhole valve comprising:

a housing comprising an upper end, a lower end, at least one port, and a bore disposed there-through, the bore comprising an inner wall surface having an upper recess and a lower recess, and the at least one port being in fluid communication with the housing bore and an outer wall surface of the housing;

a lower valve member, the lower valve member comprising a lower valve bore having at least one lower valve port in fluid communication with the lower valve bore and the bore of the housing;

an upper valve member disposed above the lower valve member, the upper valve member comprising an upper valve bore having at least one upper valve port in fluid communication with the upper valve bore and the bore of the housing, wherein the lower valve member comprises a run-in position in which the lower valve member blocks each of the at least one ports disposed in the housing and each of the at least one lower valve ports is disposed above the lower recess of the inner wall surface of the housing, and a set position in which each of the at least one ports disposed in the housing is not blocked by the lower valve member and each of the at least one lower valve ports is disposed in fluid communication with the lower recess of the inner wall surface of the housing, and wherein the upper valve member comprises a run-in position in which each of the at least one upper valve ports is disposed above the upper recess of the inner wall surface of the housing, and a set position in which each of the at least one ports disposed in the housing is blocked by the upper valve member, and each of the at least one upper valve ports is disposed in fluid communication with the upper recess of the inner wall surface of the housing, and wherein the lower valve member and the upper valve members comprise upper and lower pistons, respectively, each of the upper and lower pistons being in sliding engagement with the inner wall surface of the housing bore.

8. The downhole valve of claim 7, wherein the upper valve member further comprises an extension member disposed at a lower end of the upper valve member.

9. A downhole valve comprising:

a housing comprising an upper end, a lower end, at least one port, and a bore disposed there-through, the bore comprising an inner wall surface having an upper recess and a lower recess, and the at least one port being in fluid communication with the housing bore and an outer wall surface of the housing;

a lower valve member, the lower valve member comprising a lower valve bore having at least one lower valve port in fluid communication with the lower valve bore and the bore of the housing;

an upper valve member disposed above the lower valve member, the upper valve member comprising an upper valve bore having at least one upper valve port in fluid communication with the upper valve bore and the bore of the housing, wherein the lower valve member comprises a run-in position in which the lower valve member blocks each of the at least one ports disposed in the housing and each of the at least one lower valve ports is disposed above the lower recess of the inner wall surface of the housing, and a set position in which each of the at least one ports disposed in the housing is not blocked by the lower valve member and each of the at least one lower valve ports is disposed in fluid communication with the lower recess of the inner wall surface of the housing, and wherein the upper valve member comprises a run-in position in which each of the at least one upper valve ports is disposed above the upper recess of the inner wall surface of the housing, and a set position in which each of the at least one ports disposed in the housing is blocked by the upper valve member, and each of the at least one upper valve ports is disposed in fluid communication with the upper recess of the inner wall surface of the housing, and wherein the upper valve member comprises at least one extension member disposed at a lower end of the upper valve member, at least one of the at least one extension members of the upper valve member is in contact with an upper end of the lower valve member when the upper valve member is in the set position of the upper valve member.

10. The downhole valve of claim 9, wherein the upper valve member comprises three extensions members disposed equidistant around a circumference of the upper valve member at the lower end of the upper valve member.

11. A downhole valve comprising:

a housing comprising an upper end, a lower end, at least one port, and a bore disposed there-through, the bore comprising an inner wall surface having an upper recess and a lower recess, and the at least one port being in fluid communication with the housing bore and an outer wall surface of the housing;

a lower piston in sliding engagement with the inner wall surface of the housing, the lower piston comprising a lower piston bore having a lower piston port in fluid communication with the lower piston bore and the bore of the housing;

an upper piston in sliding engagement with the inner wall surface of the housing and disposed above the lower piston, the upper piston comprising an upper piston bore having at least one upper piston port in fluid communication with the upper piston bore and the bore of the housing and an extension member disposed at a lower end of the upper piston, wherein the lower piston comprises a run-in position in which the lower piston blocks the at least one port disposed in the housing and the lower piston port is disposed above the lower recess of the inner wall surface of the housing, and a set position in which the at least one port disposed in the housing is not blocked by the lower piston and the lower piston port is disposed in fluid communication with the lower recess of the inner wall surface of the housing, and wherein the upper piston comprises a run-in position in which the upper piston port is disposed above the upper recess of the inner wall surface of the housing, and a set position in which the at least one port disposed in the housing is blocked by the upper piston, the upper piston port being disposed in fluid communication with the upper recess of the inner wall surface of the housing, and the extension member of the upper piston is in contact with an upper end of the lower piston.

12. The downhole valve of claim 11, wherein the housing comprises a plurality of ports disposed in the housing.

13. The downhole valve of claim 12, wherein the lower piston comprises a plurality of lower piston ports and the upper piston comprises a plurality of upper piston ports.

14. The downhole valve of claim 13, wherein the upper piston comprises a plurality of extension members.

15. The downhole valve of claim 11, wherein the lower piston comprises three lower ports disposed equidistant around a circumference of the lower piston, and the upper piston comprises three upper ports disposed equidistant around a circumference of the upper piston.

16. The downhole valve of claim 11, wherein the lower piston comprises a seat disposed at an upper end of the lower piston for receiving a first plug member, and the upper piston comprises a seat disposed at an upper end of the upper piston for receiving a second plug member, the second plug member being larger than the first plug member.

17. The downhole valve of claim 11, wherein the inner wall surface of the housing bore comprises a shoulder disposed below the lower piston for engagement with a lower end of the lower piston when the lower piston is in the lower piston set position.

18. A method of opening and closing a port disposed in the housing of a downhole tool, the method comprising the steps of:

(a) installing a downhole valve in a downhole string, the downhole valve comprising a housing comprising an upper end, a lower end, at least one port, and a bore disposed there-through, the bore comprising an inner wall surface having an upper recess and a lower recess and the at least one port being in fluid communication with the housing bore and an outer wall surface of the housing, a lower piston in sliding engagement with the inner wall surface of the housing, the lower piston comprising a lower piston bore having a lower piston port in fluid communication with the lower piston bore and the bore of the housing an upper piston in sliding engagement with the inner wall surface of the housing and disposed above the lower piston, the upper piston comprising an upper piston bore having at least one upper piston port in fluid communication with the upper piston bore, wherein the lower piston comprises a run-in position in which the lower piston blocks the at least one port disposed in the housing and the lower piston port is disposed above the lower recess of the inner wall surface of the housing, and a set position in which the at least one port disposed in the housing is not blocked by the lower piston and the lower piston port is disposed in fluid communication with the lower recess of the inner wall surface of the housing, and wherein the upper piston comprises a run-in position in which the upper piston port is disposed above the upper recess of the inner wall surface of the housing, and a set position in which the at least one port disposed in the housing is blocked by the upper piston, upper piston port being disposed in fluid communication with the upper recess of the inner wall surface of the housing; then (b) running the downhole string to depth in a wellbore; then (c) moving the first piston to open the at least one port disposed in the housing to permit fluid flow through the at least one port disposed in the housing and into a wellbore environment, wherein movement of the first piston permits fluid flow through the housing bore to exit the housing bore at the lower end of the downhole valve; and then (d) moving the second piston to block the at least one port disposed in the housing to block fluid flow through the at least one port disposed in the housing, wherein movement of the second piston permits fluid flow through the housing bore to exit the housing bore at the lower end of the downhole valve.

19. The method of claim 18, wherein a first plug member is landed on the first piston to block fluid flow through the first piston causing an increase in fluid pressure above the first piston sufficient to move the first piston during step (c).

20. The method of claim 19, wherein a second plug member is landed on the second piston to block fluid flow through the second piston causing an increase in fluid pressure above the second piston sufficient to move the second piston during step (d).

21. A method of opening and closing a port disposed in the housing of a downhole tool, the method comprising the steps of:

(a) installing a downhole valve in a downhole string, the downhole valve comprising a housing comprising an upper end, a lower end, at least one port, and a bore disposed there-through, the bore comprising an inner wall surface having an upper recess and a lower recess and the at least one port being in fluid communication with the housing bore and an outer wall surface of the housing, a lower piston in sliding engagement with the inner wall surface of the housing, the lower piston comprising a lower piston bore having a lower piston port in fluid communication with the lower piston bore and the bore of the housing, an upper piston in sliding engagement with the inner wall surface of the housing and disposed above the lower piston, the upper piston comprising an upper piston bore having at least one upper piston port in fluid communication with the upper piston bore, wherein the lower piston is initially disposed in an orientation in which the at least one port disposed in the housing is not blocked by the lower piston and the lower piston port is disposed in fluid communication with the lower recess of the inner wall surface of the housing, and wherein the upper piston comprises a run-in position in which the upper piston port is disposed above the upper recess of the inner wall surface of the housing, and a set position in which the at least one port disposed in the housing is blocked by the upper piston, the upper piston port being disposed in fluid communication with the upper recess of the inner wall surface of the housing; then (b) running the downhole string to depth in a wellbore; and then (c) moving the second piston to block the at least one port disposed in the housing to block fluid flow through the at least one port disposed in the housing, wherein movement of the second piston permits fluid flow through the housing bore to exit the housing bore at the lower end of the downhole valve.

22. The method of claim 21, wherein a plug member is landed on the second piston to block fluid flow through the second piston causing an increase in fluid pressure above the second piston sufficient to move the second piston during step (c).

* * * * *